US006499941B1

(12) United States Patent
Fischer

(10) Patent No.: US 6,499,941 B1
(45) Date of Patent: Dec. 31, 2002

(54) PRESSURE EQUALIZATION IN FUEL PUMP

(75) Inventor: John Gardner Fischer, Goodrich, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/652,564

(22) Filed: Aug. 31, 2000

(51) Int. Cl.[7] ..... F04D 1/04

(52) U.S. Cl. ..... 415/55.4; 415/55.1

(58) Field of Search ..... 415/55.4, 55.1, 415/55.2, 211.2, 226, 207

(56) References Cited

U.S. PATENT DOCUMENTS 4,854,830 A * 8/1989 Kozawa et al. ..... 417/365
5,516,259 A * 5/1996 Niederkofler et al. ..... 415/55.1

* cited by examiner

*Primary Examiner*—Edward K. Look
*Assistant Examiner*—Richard A. Edgar
(74) *Attorney, Agent, or Firm*—Vincent A. Cichosz

(57) ABSTRACT

A fuel pump for a vehicle includes a pump section having a flow channel and a rotatable impeller cooperating with said flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The pump section includes a mechanism for minimizing leakage of fuel from the flow channel radially and equalizing pressure across a sealing surface of the impeller.

20 Claims, 3 Drawing Sheets

PRESSURE EQUALIZATION IN FUEL PUMP

TECHNICAL FIELD

The present invention relates generally to fuel pumps for vehicles and, more particularly, to pressure equalization in a fuel pump of a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. One type of fuel pump is known as a high-pressure turbine fuel pump. The high-pressure turbine fuel pump typically includes an impeller rotatable between inlet and outlet plates. The impeller is of a closed vane type to improve pump efficiency and performance. The impeller has a hub portion, a plurality of blade tips extending radially from the hub portion and disposed circumferentially thereabout and a peripheral ring portion extending radially from the blade tips. However, the closed vane impeller is hampered by flow loss due to wear of a peripheral ring portion that shrouds the blade tips of the impeller.

The peripheral ring that shrouds the blade tips of the closed vane impeller functions as an axial sealing surface between the fluid pressure within a flow channel and the fluid pressure surrounding a major diameter of the impeller. The pressure in an outside diameter cavity or gap formed between a major or outside diameter of the impeller and a spacer ring typically reaches equilibrium at a value equal to 50% of an outlet pressure of the fuel pump. The pressure within the flow channel can be approximated by a linear pressure gradient starting at a low pressure at an inlet port and increasing to pump outlet pressure at an outlet port. An analysis of the radial pressure differential across the peripheral ring portion of the impeller shows a leakage potential directed from the outside diameter cavity inward for the channel region of the flow channel between the inlet port and a channel length midpoint ($\Delta P$=0.5*outlet pressure channel–pressure at given channel location). Between the channel midpoint and the outlet port, the leakage potential is directed outward from the flow channel to an outside diameter cavity midpoint ($\Delta P$=channel pressure at given channel location–0.5*outlet pressure). Therefore, flow is leaking out of the last half of the flow channel and into the first half of the flow channel. The pressure differential across an axial seal surface of the peripheral ring portion of the impeller provides the potential for this leakage.

Therefore, it is desirable to minimize the flow loss associated with axial wear of the peripheral ring portion of the impeller while maintaining performance benefits the peripheral ring portion provides in a fuel pump for a vehicle. It is also desirable to provide pressure equalization of an impeller in a fuel pump for a fuel tank in a vehicle. It is further desirable to improve fuel pump durability using existing low cost materials and production feasible methods for a fuel pump for a fuel tank in a vehicle.

SUMMARY OF THE INVENTION

It is, therefore, one object of the present invention to provide pressure equalization of an impeller in a fuel pump for a fuel tank in a vehicle.

It is another object of the present invention to provide a fuel pump for a vehicle that minimizes flow loss associated with axial wear of a peripheral ring portion of an impeller.

To achieve the foregoing objects, the present invention is a fuel pump for a vehicle including a pump section having a flow channel and a rotatable impeller cooperating with said flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The pump section includes a mechanism for minimizing leakage of fuel from the flow channel radially and equalizing pressure across a sealing surface of the impeller.

One advantage of the present invention is that pressure equalization of an impeller in a fuel pump is provided for a vehicle. Another advantage of the present invention is that the fuel pump uses existing low cost materials and production feasible methods. Yet another advantage of the present invention is that the fuel pump improves fuel pump durability due to increased axial clearance and less flow loss. Still another advantage of the present invention is that the fuel pump provides a mechanism to minimize flow loss associated with axial wear of a peripheral ring portion of an impeller while maintaining the performance benefits the peripheral ring portion provides.

Other objects, features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
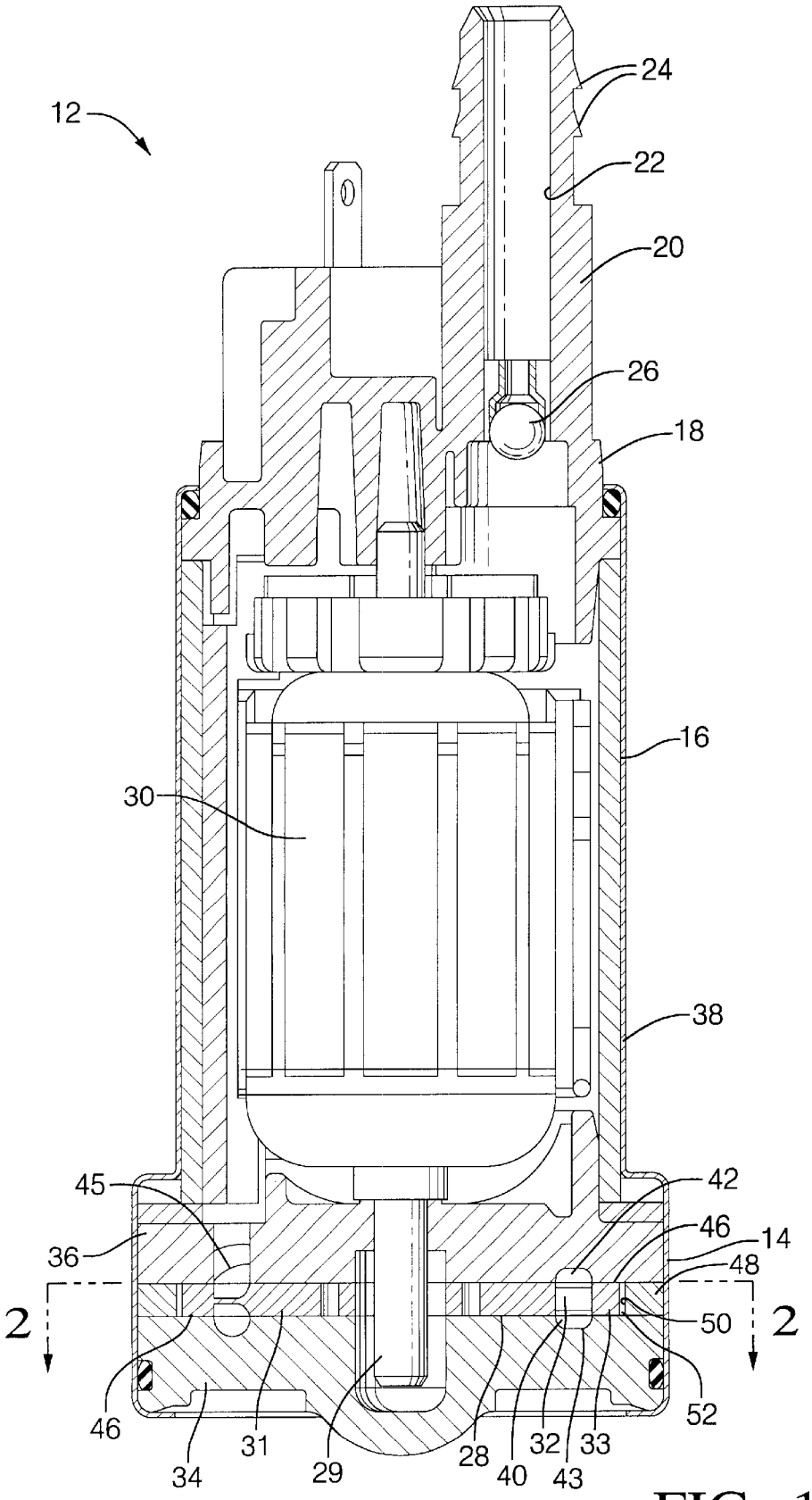
FIG. 1 is a fragmentary elevational view of a fuel pump, according to the present invention.
Figure 2:
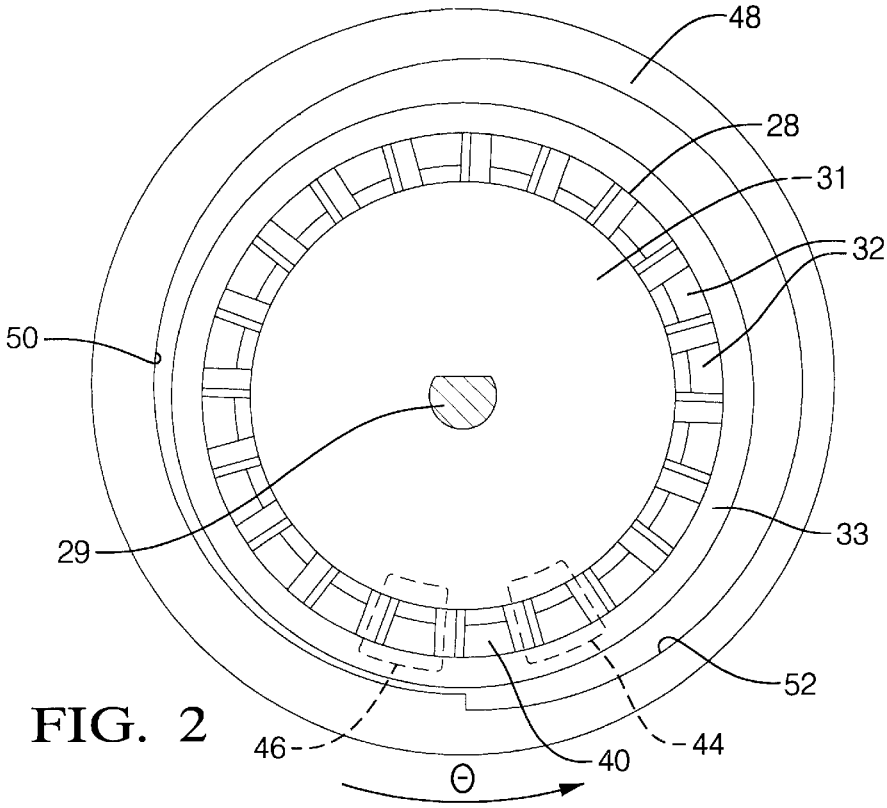
FIG. 2 is a sectional view taken along line 22 of FIG. 1.

Referring to the drawings and in particular FIGS. 1 and 2, one embodiment of a fuel pump 12, according to the present invention, is shown for a vehicle (not shown). The fuel pump 12 includes a pump section 14 at one axial end, a motor section 16 adjacent the pump section 14 and an outlet section 18 adjacent the motor section 16 at the other axial end. As known in the art, fuel enters the pump section 14, which is rotated by the motor section 16, and is pumped past the motor section 16 to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve 26 disposed in the passageway 22. It should be appreciated that the fuel flowing to the outlet section 18 flows into the outlet member 20 and through the passageway 22 and check valve 26 when open to the conduit. It should also be appreciated that, except for the pump section 14, the fuel pump 12 is conventional and known in the art.

Referring to FIGS. 1 and 2, the pump section 14 includes an impeller 28 mounted to a rotatable shaft 29 of a motor 30 of the motor section 16 for rotation therewith. The impeller 28 is generally planar and circular in shape. The impeller 28 has a hub portion 31 attached to the shaft 29 by suitable means (not shown) The impeller 28 also has a plurality of blade tips 32 extending radially from the hub portion 31 and disposed circumferentially thereabout. The impeller 28 has a peripheral ring portion 33 extending radially from the blade tips 32 to shroud the blade tips 32. The impeller 28 is made of a rigid material such as plastic.

The pump section 14 also includes an inlet plate 34 disposed axially on one side of the impeller 28 and an outlet plate 36 disposed axially on the other side of the impeller 28. The inlet plate 34 and outlet plate 36 are generally planar and circular in shape. The inlet plate 34 and outlet plate 36 are enclosed by a housing 38 and fixed thereto. The inlet plate 34 and outlet plate 36 have an inlet or first recess 40 and an outlet or second recess 42, respectively, located axially opposite the blade tips 32 adjacent to the peripheral ring portion 33 to form a flow channel 43 for a function to be described. The recesses 40 and 42 are annular and allow fuel to flow therethrough from an inlet port 44 (FIG. 2) to an outlet port 45 of the pump section 14. The peripheral ring portion 33 of the impeller 28 forms an outside diameter (OD) sealing surface 46 on both axial sides thereof with the inlet plate 34 and outlet plate 36. It should be appreciated that the impeller 28 rotates relative to the inlet plate 34 and outlet plate 36 and the inlet and outlet plates 34 and 36 are stationary.

Figure 3:
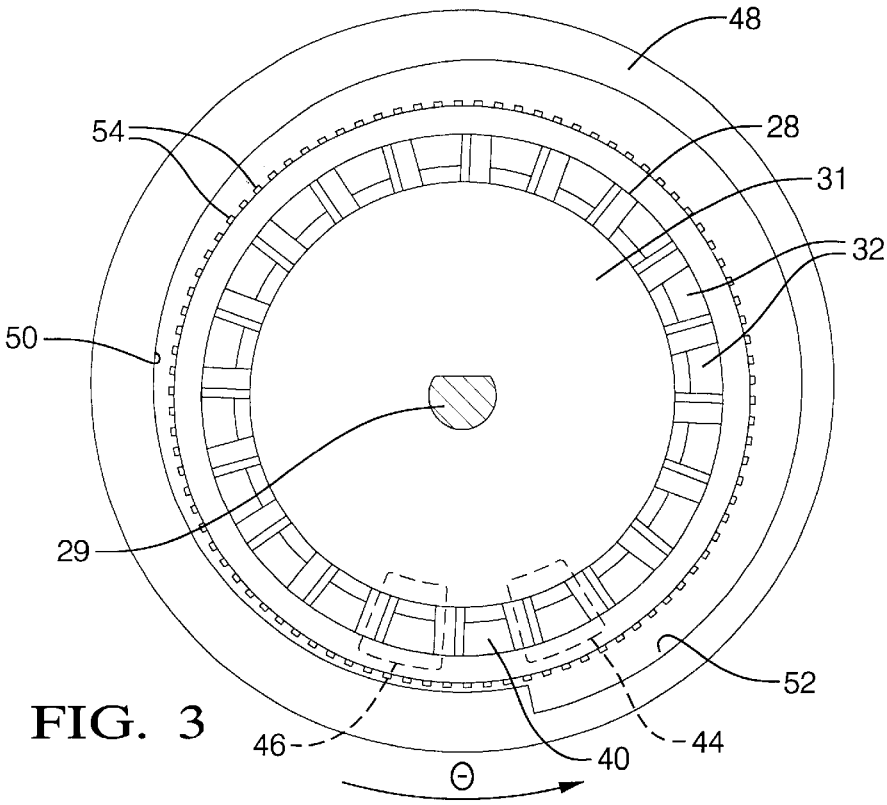
FIG. 3 is a view similar to FIG. 2 of another embodiment, according to the present invention, of the fuel pump of FIG. 1.

The pump section 14 also includes a spacer ring 48 disposed axially between the inlet plate 34 and outlet plate 36 and spaced radially-from the impeller 28 to form a gap or cavity 52 therebetween. The spacer ring 48 is fixed to the housing 38 and is stationary relative to the impeller 28. The spacer ring 48 is generally planar and circular in shape. The spacer ring 48 has an inner diameter 50 that forms a gradually reducing cross-sectional area to create an outside diameter (OD) cavity 52 between the inner diameter 50 of the spacer ring 48 and an outside diameter of the peripheral ring portion 33 of the impeller 28 and a flow stripper between the inlet and outlet recesses 40 and 42 of the flow channel 43. As illustrated in FIG. 2, the outside diameter or surface of the peripheral ring portion 33 is smooth. In another embodiment illustrated in FIG. 3, the outside diameter or surface of the peripheral ring portion 33 may include a plurality of flow enhancers such as blades 54 spaced circumferentially thereabout and extending radially into the OD cavity 52. It should be appreciated that fluid flows into the inlet recess 40 and through the flow channel 43 and out the outlet recess 42.

In operation of the fuel pump 12, the motor 30 rotates the shaft 29, which in turn, rotates the impeller 28 as indicated by the arrow. The fluid velocity created at the rotating surface of the outside diameter or surface of the peripheral ring portion 33 of the impeller 28 coupled with the viscous force gradient within the fluid cause the fluid such as fuel to flow. As the fluid flow propagates into the OD cavity 52 formed by the inner diameter profile of the spacer ring 48 and the outside diameter of the impeller 28, the fluid pressure continually increases until obtaining maximum pressure at the flow stripper. The linear pressure gradient with the flow channel 43 ($P=f(\Theta)$) and matching pressure gradient in OD cavity 52 create a pressure differential across the sealing surface 46 of zero, therefore, minimizing leakage of fuel across the sealing surface 46. The fuel flows from the inlet port through the flow channel 43 to the outlet port 45 without flowing radially across the sealing surface 46 due to pressure equalization across the sealing surface 46. It should be appreciated that by properly sizing the cross-sectional area of the OD cavity 52 and/or adding flow enhancers such as the blades 54 to the major outside diameter of the impeller 28, the pressure gradient developed in the region between the inlet port and outlet port 45 can be adjusted to match the pressure gradient within the flow channel 43. Thus, the pressure differential across the axial sealing surface 46 of the peripheral ring portion 33 of the impeller 28 is minimized and the leakage loss is reduced. It should be appreciated that, in FIG. 2, the outside diameter of the impeller 28 is smooth and a reducing outside diameter volume of the OD cavity 53 provides a mechanism to minimize leakage from the flow channel 43 to the outside diameter of the peripheral ring portion 33 of the impeller 28 by equalizing the pressure across the sealing surface 46. It should also be appreciated that, in FIG. 3, the blades 54 on the outside diameter of the impeller 28 and a reducing outside diameter volume of the OD cavity 52 provide a mechanism to minimize leakage from the flow channel 43 to the outside diameter of the peripheral ring portion 33 of the impeller 28 by equalizing the pressure across the sealing surface 46.

Figure 4:
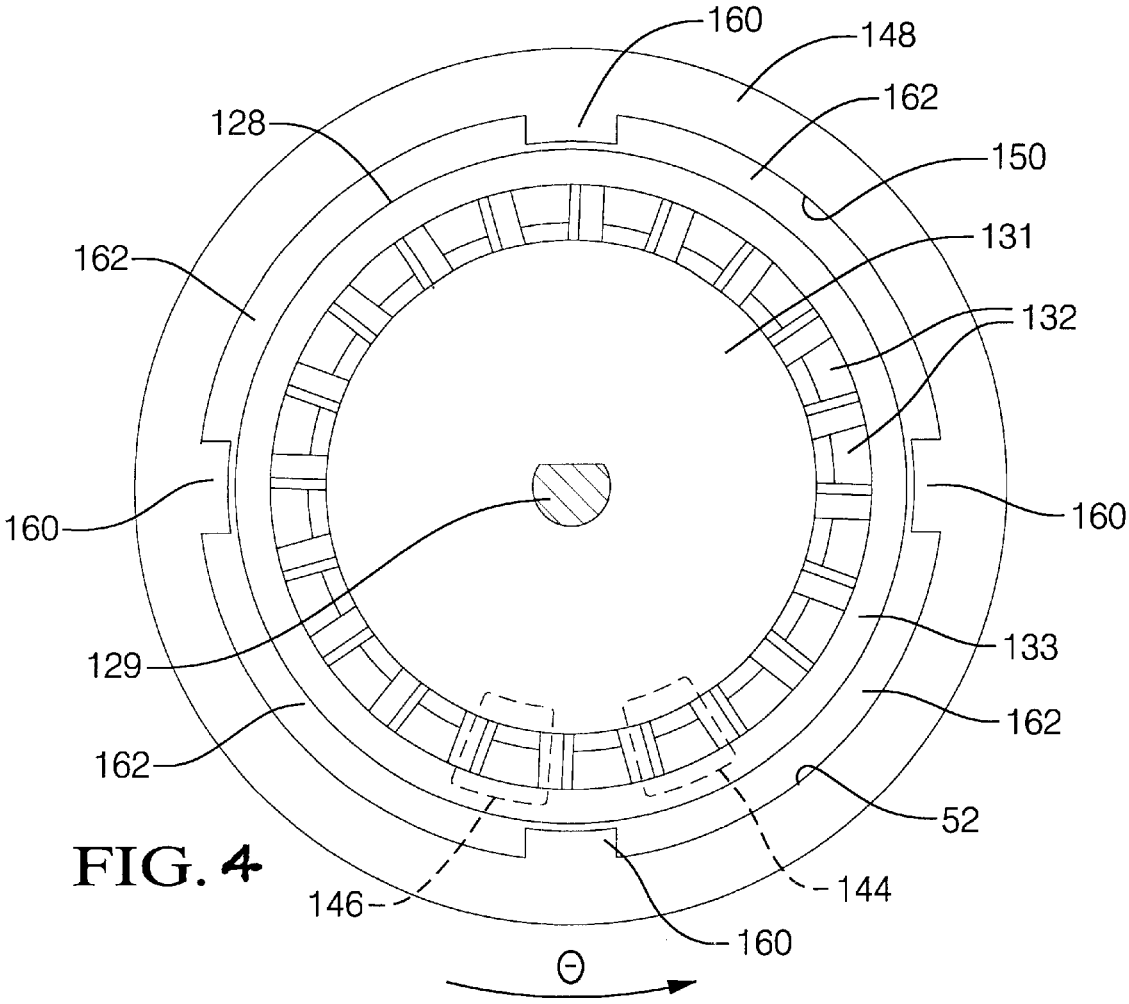
FIG. 4 is a view similar to FIG. 2 of yet another embodiment, according to the present invention, of the fuel pump of FIG. 1.

Referring to FIG. 4, yet another embodiment 112, according to the present invention, is shown of the fuel pump 12. Like parts of the fuel pump 12 have like reference numerals increased by one hundred (100). In this embodiment, the fuel pump 112 has a chambered outside diameter (OD) cavity design. The spacer ring 148 has an inner diameter 150 and a plurality of flow strippers 160 extending radially and spaced circumferentially therefrom that forms a plurality of individual chambers 162 between the inner diameter 150 of the spacer ring 148 and an outside diameter of the peripheral ring portion 133 of the impeller 128. The chambers 162 function to contain flow leakage. The pressure within each chamber 162 is approximately a nominal value of the pressure within the flow channel 143 contained within an arc length directly inboard from a corresponding chamber 162. The operation of the fuel pump 112 is similar to the fuel pump 12. It should be appreciated that the flow strippers 160 of the spacer ring 148 minimize leakage of fuel from the flow channel radially and the chambers 162 equalize pressure across the impeller 128. It should also be appreciated that by segmenting the OD chamber into discrete pressure zones or chambers 162, the overall pressure gradient and hence, fluid leakage is minimized.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump; and said pump section including means forming a reduced radially extending cross-sectional area for minimizing leakage of fuel from said flow channel radially and equalizing pressure across a sealing surface of said impeller.

2. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said pump section including means forming a reduced cross-sectional area for minimizing leakage of fuel from said flow channel radially and equalizing pressure across a sealing surface of said impeller; and wherein said means comprises a spacer ring spaced radially from said impeller and said spacer ring having a gradually reducing cross-sectional shape.

3. A fuel pump as set forth in claim 2 wherein said spacer ring has an outside diameter (OD) cavity formed on an inner peripheral surface of said spacer ring.

4. A fuel pump as set forth in claim 3 wherein said impeller has an outside peripheral surface that is smooth.

5. A fuel pump as set forth in claim 3 wherein said impeller has an outside diameter surface and a plurality of blades disposed circumferentially therealong and extending radially into said OD cavity.

6. A fuel pump as set forth in claim 3 wherein said pump section includes an inlet plate disposed axially adjacent one side of said impeller.

7. A fuel pump as set forth in claim 6 wherein said pump section includes an outlet plate disposed axially adjacent an opposed side of said impeller.

8. A fuel pump as set forth in claim 7 wherein said sealing surface is disposed axially between said impeller and said inlet plate and axially between said impeller and said outlet plate.

9. A fuel pump as set forth in claim 2 including a cavity disposed radially between said impeller and said spacer ring.

10. A fuel pump as set forth in claim 2 including a housing enclosing said pump section and said spacer ring being fixed to said housing and stationary relative to said impeller.

11. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump;

said pump section including means for minimizing leakage of fuel from said flow channel radially and equalizing pressure across a sealing surface of said impeller; and wherein said means comprises a spacer ring spaced radially from said impeller and having a plurality of flow strippers extending radially and spaced circumferentially to form a plurality of chambers between said impeller and said spacer ring.

12. A fuel pump for a fuel tank in a vehicle comprising:

a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump; and said pump section including means forming a reduced radially extending cross-sectional area for minimizing leakage of fuel from said flow channel radially and equalizing pressure across a sealing surface of said impeller.

13. A fuel pump as set forth in claim 12 wherein said impeller has an outside peripheral surface that is smooth.

14. A fuel pump as set forth in claim 12 wherein said impeller has an outside peripheral surface and a plurality of blades disposed circumferentially therealong and extending radially outward.

15. A fuel pump as set forth in claim 12 wherein said pump section includes an inlet plate disposed axially adjacent one side of said impeller.

16. A fuel pump as set forth in claim 15 wherein said pump section includes an outlet plate disposed axially adjacent an opposed side of said impeller.

17. A fuel pump as set forth in claim 16 wherein said sealing surface is disposed axially between said impeller and said inlet plate and axially between said impeller and said outlet plate.

18. A fuel pump for a fuel tank in a vehicle comprising:

a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said pump section including means forming a reduced cross-sectional area for minimizing leakage of fuel from said flow channel radially and equalizing pressure across a sealing surface of said impeller; and wherein said means comprises a spacer ring spaced radially from said impeller and said spacer ring having a gradually reducing cross-sectional shape.

19. A fuel pump for a fuel tank in a vehicle comprising:

a housing;

a pump section disposed in said housing having a flow channel and a rotatable impeller cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump;

said pump section including means forming a reduced cross-sectional area for minimizing leakage of fuel from said flow channel radially and equalizing pressure across a sealing surface of said impeller; and wherein said means comprises a spacer ring spaced radially from said impeller and said spacer ring having a plurality of flow strippers extending radially and spaced circumferentially to form a plurality of chambers between said impeller and said spacer ring.

20. A fuel pump for a vehicle comprising:

a housing;

a pump section disposed in said housing having a flow channel and a rotatable impeller cooperating with said flow channel to pump fuel therethrough, said impeller having a hub portion, a plurality of blade tips extending radially from and disposed circumferentially about said hub portion and a peripheral ring portion extending radially from said blade tips;

a motor section disposed in said housing adjacent said pump section and having a motor to rotate said impeller;

an outlet section disposed in said housing adjacent said motor section to allow pumped fuel to exit said fuel pump; and said pump section including a spacer ring spaced radially from said peripheral ring portion and said spacer ring having a gradually reducing cross-sectional shape to form a cavity for minimizing leakage of fuel from said flow channel to said impeller and equalizing pressure across a sealing surface of said impeller.

* * * * *